United States Patent [19]

Yamagata et al.

[11] Patent Number: 4,464,642

[45] Date of Patent: Aug. 7, 1984

[54] CIRCUIT BREAKER

[75] Inventors: Shinji Yamagata; Fumiyuki Hisatsune; Junichi Terachi, all of Fukuyama; Hajimu Yoshiyasu, Itami, all of Japan

[73] Assignee: Mitsubishi Denki Kabushiki Kaisha, Tokyo, Japan

[21] Appl. No.: 356,144

[22] Filed: Mar. 8, 1982

[30] Foreign Application Priority Data

| | | | |
|---|---|---|---|
| Mar. 12, 1981 | [JP] | Japan | 56-35552[U] |
| Mar. 12, 1981 | [JP] | Japan | 56-35554[U] |
| Mar. 12, 1981 | [JP] | Japan | 56-35555[U] |
| Mar. 12, 1981 | [JP] | Japan | 56-35556[U] |
| Mar. 12, 1981 | [JP] | Japan | 56-35557[U] |

[51] Int. Cl.[3] ..... H01H 9/30

[52] U.S. Cl. ..... 335/201; 200/144 R

[58] Field of Search ..... 335/16, 195; 200/144 R, 200/144 AB, 304, 305; 361/13

[56] References Cited

U.S. PATENT DOCUMENTS

| | | | |
|---|---|---|---|
| 3,127,488 | 3/1964 | Bodenschatz | 335/16 |
| 3,359,485 | 12/1967 | Bühler | 335/16 |
| 3,402,273 | 9/1968 | Davis | 200/144 R |
| 3,464,038 | 8/1969 | Murai et al. | 335/16 |
| 3,469,216 | 9/1969 | Shiraishi | 335/16 |
| 3,500,266 | 3/1970 | Torre | 335/16 |
| 3,517,356 | 6/1970 | Hanafusa | 335/16 |

*Primary Examiner*—Harold Broome

*Attorney, Agent, or Firm*—Wenderoth, Lind & Ponack

[57] ABSTRACT

The present invention consists in a circuit breaker wherein a pair of rigid conductors which are disposed therein and at least one of which has a movable portion that separates a pair of contacts on the basis of the electromagnetic force of an excess current flowing through the contacts adapted to come into and out of contact with and from each other, are provided with arc shields in a manner to surround the contacts, thereby to bring forth the effects of increasing the arc voltage of an electric arc struck across the contacts and raising the separating speed of the contacts.

5 Claims, 32 Drawing Figures

CIRCUIT BREAKER

BACKGROUND OF THE INVENTION

The present invention relates to a circuit breaker. More particularly, it relates to a novel circuit breaker which is so constructed as to raise the separating speed of the contacts thereof and to effectively increase the arc voltage of an electric arc struck across the contacts and thus attain an enhanced current-limiting performance.

Prior-art circuit breakers have had the disadvantage that an electric arc struck across contacts expands its feet to the parts of rigid conductors near the contacts, so the metal particles of the contacts cannot be effectively injected into the arc. With the prior art devices, it has been impossible to achieve the aforementioned effects of the circuit breaker according to the present invention.

SUMMARY OF THE INVENTION

The present invention provides a circuit breaker wherein a pair of rigid conductors which are disposed therein and at least one of which has a movable portion that separates a pair of contacts on the basis of the electromagnetic force of an excess current flowing through the contacts adapted to come into and out of contact with and from each other, are provided with arc shields of a high resistivity material which surround the contacts. Owing to the arc shields, the feet of the electric arc are prevented from spreading to the parts of the rigid conductors near the contacts, thereby to effectively inject the metal particles of the contacts into the arc and to raise the arc voltage of the electric arc, and the pressure in the arc space of the electric arc is increased, thereby to raise the separating speed of the contacts.

BRIEF DESCRIPTION OF THE DRAWINGS

In the drawings, the same symbols indicate the same or corresponding parts.

DETAILED DESCRIPTION OF THE INVENTION

Figure 1A:
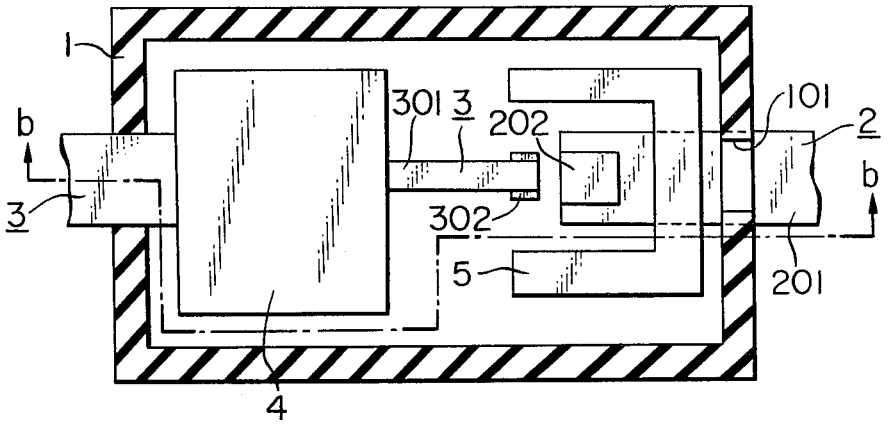
FIG. 1(a) PRIOR ART
FIG. 1*a* is a sectional plan view of a conventional circuit breaker to which the present invention is applicable.
Figure 1B:
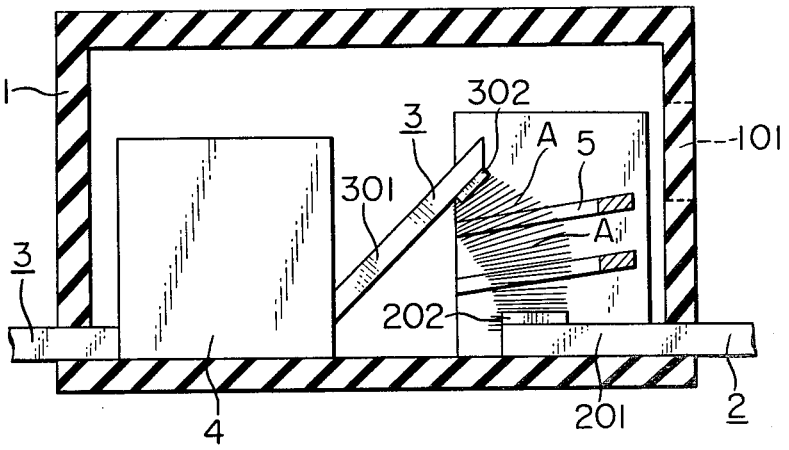
FIG. 1(b) PRIOR ART
FIG. 1*b* is a sectional side view taken along line b—b in FIG. 1*a*.

FIG. 1(*a*) is a sectional plan view showing a conventional circuit breaker, while FIG. 1(*b*) is a sectional side view taken along line b—b in FIG. 1(*a*). In FIGS. 1(*a*) and 1(*b*), assuming now that a movable-side contact 302 of a movable contactor 3 and a stationary-side contact 202 of a stationary contactor 2 are closed, current flows along the path of a stationary rigid conductor 201→the stationary-side contact 202→the movable-side contact 302→a movable rigid conductor 301.

When, with the parts in this state, a high current such as short-circuit current flows through the circuit, an operating mechanism 4 operates to separate the movable-side contact 302 from the stationary-side contact 202. At this time, an electric arc A appears across the stationary-side contact 202 and the movable-side contact 302, and an arc voltage develops thereacross. The arc voltage rises as the distance of separation of the movable-side contact 302 from the stationary-side contact 202 increases. Simultaneously therewith, the arc A is drawn toward arc extinguishing plates 5 by a magnetic force and is stretched, so that the arc voltage rises still more. In this manner, the arc current reaches the current zero point to extinguish the arc A, so that the interruption is completed. During such interrupting operation, large quantities of energy are generated across the movable-side contact 302 and the stationary-side contact 202 in a short time or several milliseconds by the arc A. In consequence, the temperature of the gas within an enclosure 1 rises, and also the pressure thereof rises abruptly, but the gas at the high temperature and under the high pressure is emitted into the atmosphere through an exhaust port 101.

At the time of the interruption, the circuit breaker and its internal constituent parts perform the operations as described above. Now, the operations of the stationary-side contact 202 and the movable-side contact 302 will be more particularly explained. In general, the arc resistance R is given by the following expression:

$$R=\rho(l/S)$$

where $\rho$: arc resistivity ($\Omega$·cm)

l: arc length (cm)

S: arc sectional area ($cm^2$)

In general, in a short arc A which has a high current of at least several kA and an arc length l of at most 50 mm, the arc space is occupied by the metal particles of rigid conductors which have arc feet contacting their surfaces. Moreover, the emission of the metal particles occurs orthogonally to the conductor surfaces. Upon the emission, the emitted metal particles have a temperature close to the boiling point of the metal of the rigid conductors. Further, as soon as the metal particles are injected into the arc space, they are supplied with electrical energy so as to be raised in temperature and pressure and to have a conductivity, and they flow away from the rigid conductors at high speed along paths which diverge in a direction conforming with the pressure distribution of the arc space. The arc resistivity $\rho$ and the arc sectional area S in the arc space are determined by the quantity of the metal particles produced and the direction of emission thereof. Accordingly, the arc voltage is determined by the behaviour of such metal particles. Next, the behaviour of such metal particles will be described with reference to FIG. 2. Even when surfaces X are constituted contact members, the behaviour of metal particles to be described below holds quite similarly.

Figure 2:
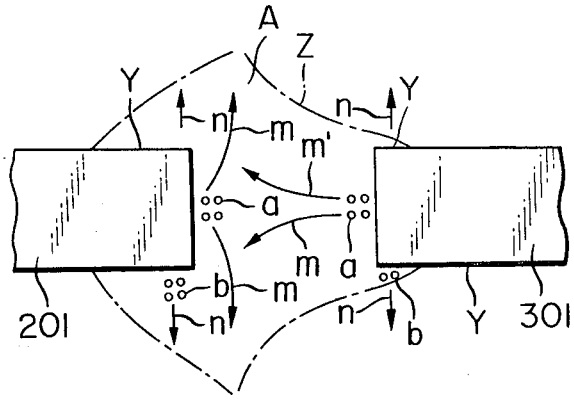
FIG. 2 is a diagram showing the behaviour of an electric arc which is struck across the contacts of the circuit breaker in FIG. 1*a*.

Referring to FIG. 2, a pair of rigid conductors 201 and 301 are ordinary conductors in the form of metallic cylinders confronting each other. The rigid conductor 201 is an anode, while the rigid conductor 301 is a cathode. The surfaces X of the respective conductors 201 and 301 are opposing surfaces which serve as contacting surfaces when the conductors 201 and 301 come into contact, and the surfaces Y of the respective conductors 201 and 301 are conductor surfaces which are electrically contacting surfaces other than the opposing surfaces X. The contour 2 indicated by the dot-and dash line in the figure is the envelope of the arc A struck across the rigid conductors 201 and 301. Further, metal particles a and metal particles b are typically representative of the metal particles which are respectively emitted from the surfaces X and Y of the conductors 201 and 301 by vaporization etc. The directions of emission of the metal particles a and b are the directions of flow lines indicated by arrows m and n, respectively.

Such metal particles a and b emitted from the conductors 202 and 301 have their temperature raised by the energy of the arc space from approximately 3,000° C., which is the boiling point of the metal of the conductors, to a temperature at which the metal particles have a conductivity, i.e., at least 8,000° C. or to a still higher temperature of approximately 20,000° C. In the process of the temperature rise, the metal particles take energy out of the arc space and thus lower the temperature of the arc space, resulting in an increased arc resistance R. The quantity of energy which the metal particles a and b take from the arc space increases with the extent of the temperature rise of the metal particles. In turn, the extent of the temperature rise is determined by the positions and emission paths in the arc space, of the metal particles a and b emitted from the conductors 201 and 301.

Further, the paths of the metal particles a and b emitted from the conductors 201 and 301 are determined depending upon the pressure distribution in the arc space.

The pressure of the arc space is determined by the mutual relationship between the pinch force in the current itself and the thermal expansion of the metal particles a and b. The pinch force is a quantity which is substantially determined by the density of the current. In other words, it is determined by the size of the foot of the arc A on the conductors 201 and 301. In general, the metal particles a and b may be considered to fly in the space determined by the pinch force while thermally expanding.

It is also known that, in case the feet of the arc A on the conductors 201 and 301 are not limited, the metal particles a blow unidirectionally from one conductor 301 against the other conductor 201 in the form of vapor jet. When, in this manner, metal particles a blow unidirectionally from the one conductor 301 toward the other conductor 201, metal particles a to be injected into the positive column of the arc A are supplied substantially from only the conductor on one side 301. While FIG. 2 illustrates by way of example the case where the metal particles are blowing strongly from the cathode against the anode, they sometimes blow in the opposite direction.

The above circumstances will now be described. In FIG. 2, it is supposed that the blowing is proceeding unidirectionally from the conductor 301 toward the conductor 201 for some reason. The metal particles a starting from the surface X of the conductor 301 tend to fly orthogonally to the conductor surface, in other words, toward the positive column of the arc. At this time, a metal particle a having started from the surface X of one conductor 301 is injected into the positive column by the pressure caused by the pinch force. In contrast, a metal particle a having started from the surface X of the other conductor 201 is pushed by the particle stream in the positive column and ejected outside the surface X, and it is immediately forced out of the system without entering the positive column. In this manner, the movements of the metal particle a emitted from the conductor 201 and that of the metal particle a emitted from the conductor 301 are different as indicated by the flow lines designated by the arrows m and m' in FIG. 2. As stated before, this is based on the difference between the pressures caused by the pinch forces on the conductor surfaces. Thus, the unidirectional blowing from the conductor 301 heats the conductor 201 on the blown side and expands the foot (anode spot or cathode spot) of the arc on the surface of the conductor 201 from the front surface X thereof to the other surface thereof. In consequence, the current density on the conductor surface of the conductor 201 falls, and also the pressure of the arc falls. Accordingly, the unidirectional blowing from the conductor 301 is increasingly intensified. The discrepancy of the flight paths of the metal particles a emitted from the respective conductors 201 and 301 which has thus occurred, results in the discrepancy of a quantities of energy to be taken from the arc space. Accordingly, the metal particle a which has started from the surface X of the conductor 301 can absorb energy from the positive column sufficiently, whereas the metal particle a which has started from the surface X of the conductor 201 cannot absorb energy sufficiently and is ejected out of the system without cooling the arc A effectively. On the other hand, the metal particles b emitted from the surfaces Y of the respective conductors 201 and 301 do not deprive the arc A of sufficient heat as indicated by the flow lines designated by the arrows n in the figure. Moreover, they increase the arc sectional area S, resulting in a lowered arc resistance R of the arc A.

In this manner, in the presence of the blowing from one conductor 301, the efficiency of the cooling of the positive column by the metal particles a worsens. In addition, the metal particles b appearing from the surfaces Y of both the conductors 201 and 301 other than the opposing surfaces thereof do not contribute to the cooling of the positive column at all, and they even lower the arc resistance R by increasing the arc sectional area S.

Accordingly, the presence of the unidirectional blowing of the metal particles from one conductor to the other conductor is disadvantageous for raising the arc voltage and renders it impossible to enhance the current-limiting performance at the time of tripping.

In general, the stationary rigid contactor and the movable rigid contactor used in the conventional circuit breaker have large opposing surface areas similarly to the rigid conductors of FIG. 2, so that they cannot limit the size of the foot of the struck arc, which is disadvantageous. Moreover, the contactors have exposed surfaces such as side surfaces in addition to the opposing surfaces, so that as explained with reference to FIG. 2, the position and size of the feet (anode spot and cathode spot) of the arc appearing on the surfaces of both the conductors cannot be limited. In the operation explained with reference to FIG. 2, accordingly, the unidirectional blowing of the metal particles a from one contactor against the other contactor proceeds and therefore the arc sectional area increases, so that the current-limiting performance at the time of tripping cannot be enhanced as stated above.

Figure 3A:
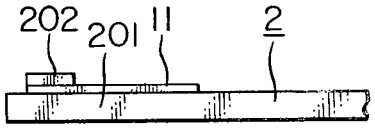
FIG. 3(a) PRIOR ART
FIG. 3*a* is a side view of a known contactor.
Figure 3C:
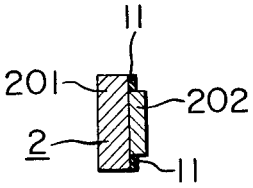
FIG. 3*c* is a sectional front view taken along c—c in FIG. 3*b*.
Figure 3B:
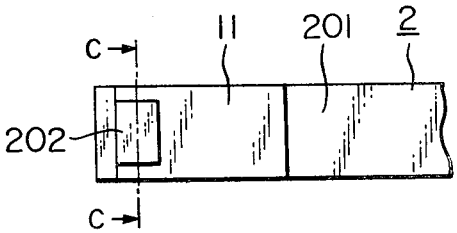
FIG. 3(b) PRIOR ART
FIG. 3*b* is a plan view of the contactor in FIG. 3*a*.

An example of another contactor used in a prior-art circuit breaker, is one in which the part of a conductor surface in the vicinity of a contact is covered with an insulator 11 in order to prevent the fusion of the conductor to its closeness to the contact. FIG. 3(*a*) is a side view showing such contactor 2, FIG. 3(*b*) is a plan view of the contactor in FIG. 3(*a*), and FIG. 3(*c*) is a sectional view taken along section c—c in FIG. 3(*b*). In the example, the fore end part of the conductor is not covered with the insulator 11.

Figure 4A:
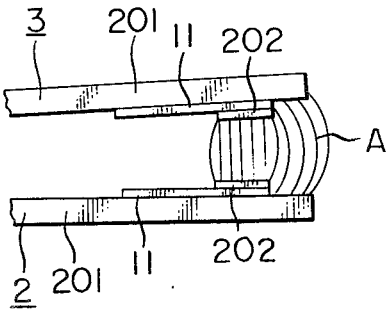
FIG. 4(a) PRIOR ART
FIG. 4*a* is a side view showing in diagrammatic fashion the state of an electric arc in the case where the contactor in FIG. 3*a* is used in a circuit breaker.
Figure 4B:
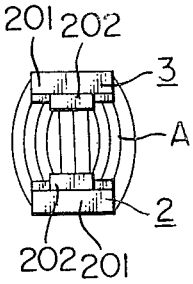
FIG. 4(b) PRIOR ART
FIG. 4*b* is a front view corresponding to FIG. 4*a*.
Figure 5:
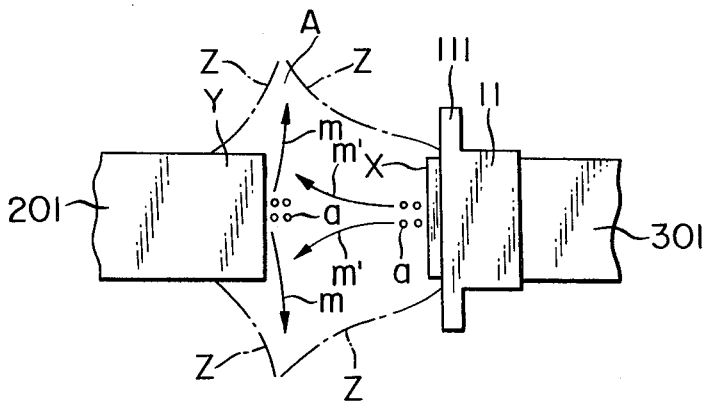
FIG. 5 is a diagram showing the behaviour of the arc in FIG. 4*a*.

In a circuit breaker constructed as shown in FIGS. 4(*a*) and 4(*b*) by the use of a pair of rigid conductors of such construction, an electric arc A as illustrated in the figures develops across the paired stationary contactor 2 and movable contactor 3. In the arc A, its feet or the positions of an anode spot and a cathode spot flare greatly toward the fore ends of the rigid conductors as is apparent from FIGS. 4(*a*) and (*b*), so there has been the disadvantage that the current-limiting performance at the time of tripping cannot be enhanced for the same reason as explained with reference to FIG. 2. Further, regarding the case where as shown in FIG. 5, only one of a pair of contacts is provided with a coating in the form of a plate-shaped member 11 of an insulator material covering the peripheral part of the contacting surface thereof, the state of the surface has been examined. In this example, metal particles a whose flow directions are limited are injected into an arc positive column portion from the surface X of the rigid conductor 301 which has the contact enclosed with the insulator 11. However, as regards metal particles from the surface X of the rigid conductor 201 which does not have the contact coated with the insulator 11 the foot of an arc or the anode spot or cathode spot thereof spreads over the whole conductor surface without being limited and further spreads to surfaces Y which have the side surfaces of the contact, so that the current density decreases. It is accordingly the same as in FIG. 2, namely the pinch force weakens and the metal particles run out of the arc. Therefore, even when the insulator is disposed in the vicinity of one conductor, the aspect of the arc positive column portion eventually becomes the phenomenon of the unidirectional blowing of the metal particles. Accordingly, both the conductors show the same characteristics as in the case where the size of the foot of the arc is not limited, and the arc voltage does not show any especially great rise, so that the current-limiting performance is not enhanced.

As explained above, in order to raise the arc voltage, the metal particles appearing in the feet of the arc need to be effectively injected into the positive column from both the electrodes. The force which injects the metal particles into the positive column is the pressure based on the pinch force arising in the foot of the arc. Since the pinch force changes greatly depending upon the size of the foot of the arc on the contactor or upon the current density, it can be controlled. For example, in the conventional contactors, the area of the surface X of at least one contactor is large, and it does not limit the size of the foot of the arc to an effective degree. Even in such contactors employing no insulator, however, when the opposing surfaces X of both the contactors are made sufficiently small, the density of current on the surfaces X rises to some extent, to increase the pinch forces, and the metal particles of the respective contactors are injected from both the sides into the positive column to some extent unlike the situations of the prior art, whereby the arc voltage becomes higher than in the prior art.

Using only this measure, however, the spread of the foot of the arc to parts other than the surfaces X or to the surfaces Y cannot be checked, and the current density on the surfaces X decreases corresponding to the spread of the foot of the arc to the surfaces Y, so that the injection pressure of the metal particles fails. In case of the conventional contactors, accordingly, the effect of cooling the positive column by the metal particles is not demonstrated to the utmost.

Further, the serious disadvantage of the conventional contactors is that, on account of the spread of the foot of the arc to the surface Y, the foot of the arc is liable to spread directly to the joint between the contact and the conductor which is usually set on the surface Y, so a joint member having a low fusing point is melted by the heat of the arc, the contact thus being prone to fall off.

This invention seeks to provide a circuit breaker which has a high arc voltage and exhibits a good current-limiting performance at the time of tripping thereof and which is free from the disadvantage of falling-off of the contacts.

The circuit breaker of this invention is characterized in that except for a part of the electrically contacting surface of either contact of the circuit breaker, the part of a rigid conductor in the vicinity of the contact which projects to the surrounding space is concealed behind an arc shield (a plate-shaped pressure reflector or a covering such as taping and coating) which is made of a substance of a highly resistive material (hereinbelow, called the "high resistivity material") having a resistivity higher than that of the material forming the rigid conductor, thereby to forcibly inject metal particles into the arc space, and that the electrodes are separated at high speed by a high pressure generated due to the provision of the arc shield.

Here, as the high resistivity material, there can be used, for example, an organic or inorganic insulator, or a high resistivity metal such as copper-nickel, copper-manganese, manganin, iron-carbon, iron-nickel and iron-chromium. It is also possible to use iron the resistance of which increases abruptly in accordance with a temperature rise.

Figure 6A:
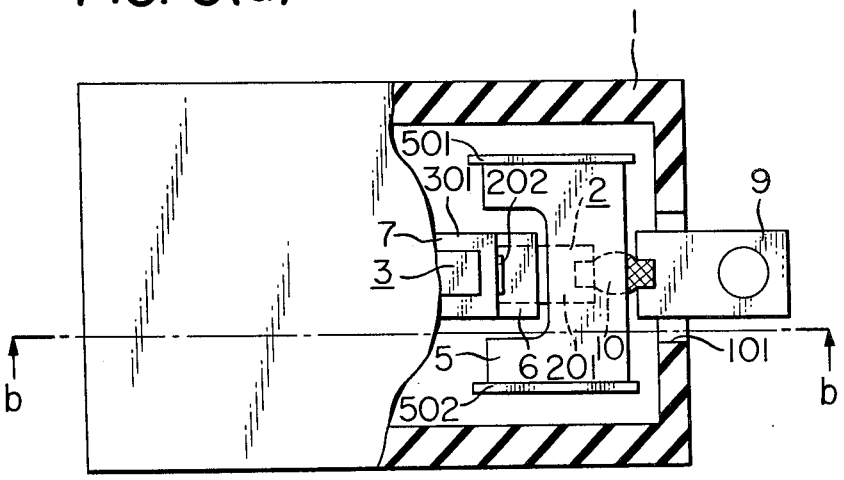
FIG. 6*a* is a partial sectional plan view showing an embodiment of a circuit breaker according to the present invention.
Figure 6B:
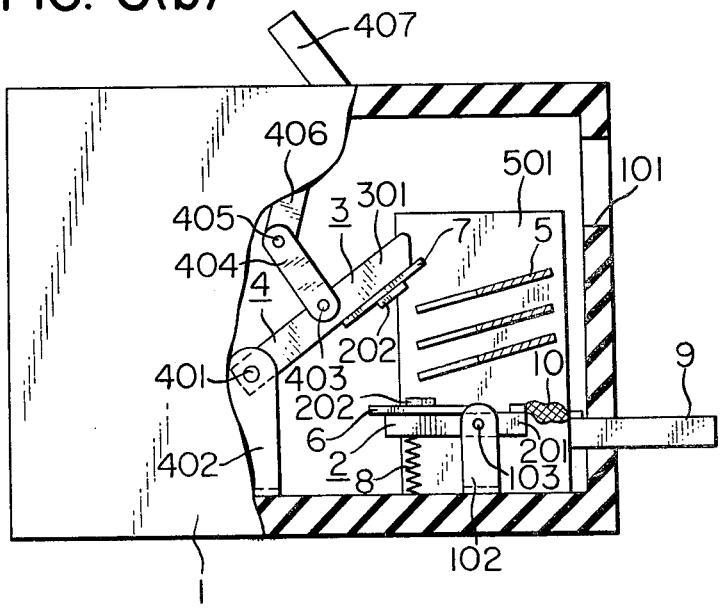
FIG. 6*b* is a partial sectional side view taken along line b—b in FIG. 6*a*, and shows the state in which the contacts of the circuit breaker are disengaged.

FIG. 6(*a*) is a sectional plan view showing one embodiment of the circuit breaker according to this invention, while FIG. 6(*b*) is a sectional side view taken along line b—b in FIG. 6(*a*). In FIGS. 6(*a*) and 6(*b*), an enclosure 1 is made of an insulator of which and forms the outer frame of a switching device, and it is provided with an exhaust port 101. A first movable contactor 2 is constructed of a first movable rigid conductor 201 whose intermediate part is rotatably supported by a pivot pin 103 on a holder 102 that is fixed to the enclosure 1, and a first contact 202 which is mounted on one end part of the first movable rigid conductor 201. A second movable contactor 3 is constructed of a second movable rigid conductor 301 which moves relative to the first movable rigid conductor 201 in order to close or open the circuit breaker, and a second contact 302 which is mounted on one end part of the second movable rigid conductor 301 in a manner to confront the first contact 202. An operating mechanism 4 operates the second movable contactor 3 relative to the first movable contactor 2 in order to close or open the circuit breaker, and is known from, e.g., U.S. Pat. No. 3,171,922 issued to K. J. Stokes. In the present embodiment, it is constructed of a supporter 402 which pivotably supports the other end part of the second movable rigid conductor 301 by means of a pivot pin 401, a lower link 404 one end part of which is pivotably mounted on the intermediate part of the second movable rigid conductor 301 by a pivot pin 403, an upper link 406 one end of which is pivotably mounted on the other end part of the lower link 404 by a pivot pin 405, and an operating handle 407 which is turnably mounted on the other end part of the upper link 406 by a pivot pin (not shown). Arc extinguishing plates 5 extinguish an electric arc struck when the second contact 302 is separated from the first contact 202, and are supported by a pair of side plates 501 and 502. Arc shields 6 and 7 are made of the aforementioned high resistivity material, and are respectively mounted on the first and second movable rigid conductors 201 and 301 in a manner to protect the first and second contacts 202 and 302 and to oppose to the electric arc. A spring 8 is interposed between the enclosure 1 and the first movable rigid conductor 201, and urges the first contact 202 against the second contact 302. A connection terminal 9 is connected to the first movable rigid conductor 201 through a flexible conductor 10, and it is also connected to an external conductor (not shown).

Figure 7:
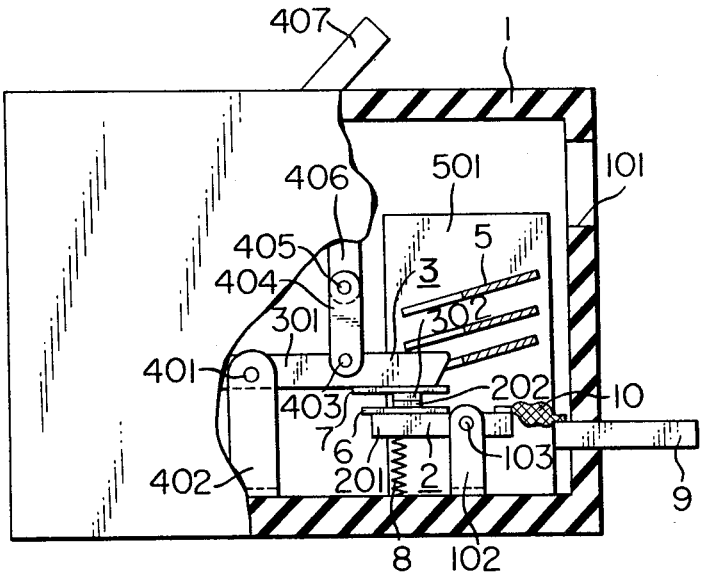
FIG. 7 is a partial sectional side view showing the state in which the contacts of the circuit breaker in FIG. 6*a* are engaged.

Now, when the operating handle 407 is turned clockwise from the state illustrated in FIG. 6(*b*), the linkage composed of the upper and lower links 406 and 404 operates to engage the first and second contacts 202 and 302 as illustrated in FIG. 7. Accordingly, current flows from a power supply side onto a load side along the connection terminal 9→flexible conductor 10→first movable rigid conductor 201→first contact 202→second contact 302→second movable rigid conductor 301. When, with the parts in this state, a high current such as a short-circuit current flows through the circuit, the second contact 302 is separated from the first contact 202 by an electromagnetic repulsive force based on current concentration in the contacting points of the contacts 202 and 302. At this time, an electric arc develops across the first contact 202 and the second contact 302. In the arc, as illustrated in FIG. 8, metal particles are reflected by the arc shields 6 and 7 to make the pressure in the arc space high, with the result that the separation of the contacts is promoted and that the arc is effectively cooled.

Figure 8:
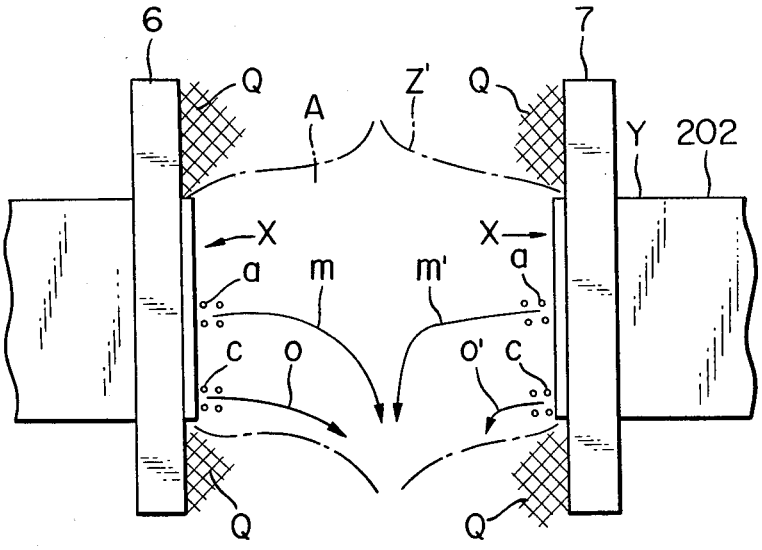
FIG. 8 is a diagram showing the action of arc shields used in the circuit breaker according to the present invention.

FIG. 8 is an explanatory diagram of the behaviour of the metal particles in the circuit breaker of FIGS. 6(*a*) and 6(*b*). Even in a case where surfaces X are formed of contact members, the behaviour of the metal particles does not differ from the ensuing explanation at all. In FIG. 8, a pair of rigid conductors 201 and 301 are constructed in the same shape as in FIG. 2, and the arc shields 6 and 7 are respectively mounted on the conductors 201 and 301 in a manner to protect the surfaces X which are the mutually confronting surfaces of the conductors 201 and 301 and to oppose the arc A. Although pressure values in spaces Q cannot exceed the pressure value of the space of the arc A itself, much higher values are exhibited at least in comparison with values in the case where the arc shields 6 and 7 are not present. Accordingly, the peripheral spaces Q which have considerably high pressures caused by the arc shields 6 and 7 produced forces suppressing the spread of the space of the arc A and "narrow" the arc A so that it is confined within a small space. This results in narrowing and confining into the arc space the flow lines m, m', o and o' of the metal particles a, c etc. emitted from the opposed surfaces X. Therefore, the metal particles a and c emitted from the surfaces X are effectively injected into the arc space. As a result, the large quantities of the metal particles a and e which are effectively injected deprive the arc space of large quantities of energy beyond comparison with those in the prior-art device and therefore cool the arc space remarkably. Accordingly, the resistivity $\rho$ or the arc resistance R is raised remarkably, and the arc voltage is raised very greatly.

Further, when the arc shields 6 and 7 are installed near the environs of the contacting surfaces of the first contact 202 and the second contact 302 as shown by way of example in FIGS. 6(*a*) and 6(*b*), in other words, the opposed surfaces X as shown in FIG. 8, the arc A is prevented from moving to conductor surfaces Y, so that the size of the feet of the arc A is also limited. For this reason, the generation of the metal particles a and c can be concentrated on the surfaces X, and also the arc sectional area S can be reduced, whereby the effective injection of the metal particles a and c into the arc space is further promoted. Accordingly, the cooling of the arc space, the rise of the arc resistivity $\rho$ and the rise of the arc resistance R are further promoted, and the arc voltage is raised more.

Figure 9:
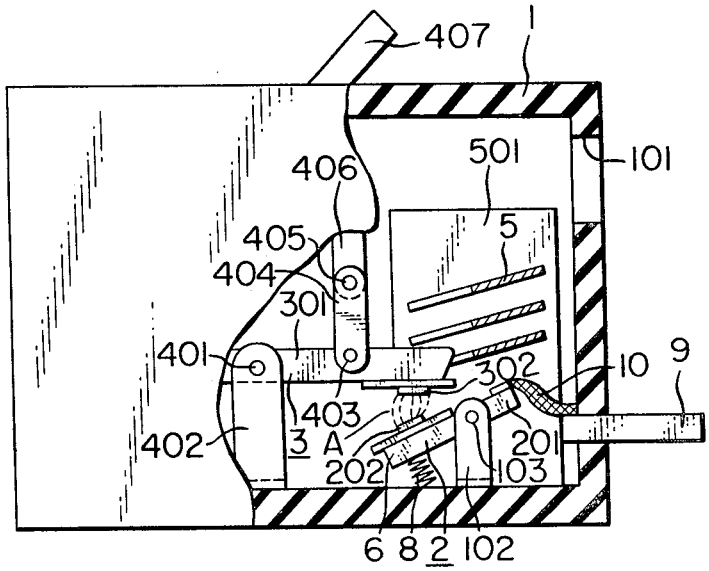
FIG. 9 is a partial sectional side view showing the state in which the contacts of the circuit breaker in FIG. 6*a* have begun to separate.

The first movable rigid conductor 201 is pivotably held on the holder 102 by the pivot pin 103, so that when the arc A has developed immediately after the separation of the first and second contacts 202 and 302, the first movable rigid conductor 201 is separated from the second movable rigid conductor 301 at very high speed by the forces based on the pressures in the spaces Q which are made very high due to the effect of the arc shields 6 and 7. This state immediately after the separation is shown in FIG. 9. More specifically, before the open state shown in FIG. 6(*b*) is reached, the second movable rigid conductor 301 can have only a comparatively low separating speed on account of the inertia of the operating mechanism 4, whereas the first movable rigid conductor 201 has a very high separating speed due to the pressure in the space Q. Therefore, the rise of the arc voltage immediately after the separation of the first and second contacts 202 and 302 is abrupt, and the peak value of the current flow through the circuit is suppressed.

For the arc extinguishing plates 5, a magnetic material may be employed so as to attract the arc A and to consequently raise the arc voltage, or a nonmagnetic material may also be employed so as to split the arc A and to consequently raise the arc voltage. With the magnetic material, the cooling of the arc A is favorably executed, but a temperature rise attributed to eddy current due to the magnetic material poses a problem in a circuit breaker of high current rating. With the nonmagnetic material, this problem is not present.

Figure 11:
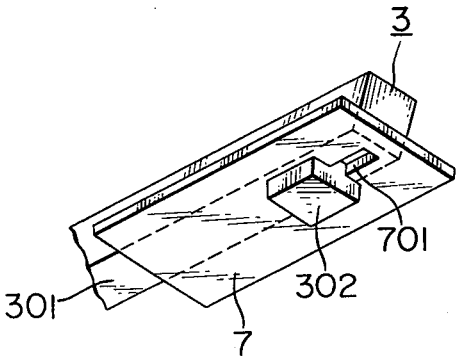
FIG. 11 is a perspective view of the other contactor which corresponds to the contactor in FIG. 10.
Figure 10:
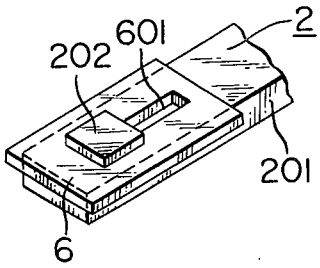
FIG. 10 is a perspective view of one contactor showing another embodiment of the arc shield for use in the circuit breaker of the present invention.

FIGS. 10 and 11 are perspective views showing another embodiment of the arc shields, which can be applied also to other embodiments to be described later. Referring to FIGS. 10 and 11, grooves or arc runways 601 and 701 are respectively provided in the arc shields 6 and 7 in the directions from the first and second contacts 202 and 302 toward the arc extinguishing plates 5 so as to expose the first and second movable rigid conductors 201 and 301. Owing to the provision of the grooves 601 and 701, the arc A runs toward the arc extinguishing plates 5 within these grooves, and it is effectively extinguished when it touches the arc extinguishing plates 5.

The embodiment of the circuit breaker according to this invention is constructed as described above and is adapted to permit the first movable rigid conductor 201 to separate at high speed by providing the arc shields 6 and 7, so that the arc voltage can be raised far beyond the limit thereof in the prior-art circuit breaker and so that a high current-limiting performance can be attained.

Figure 12A:
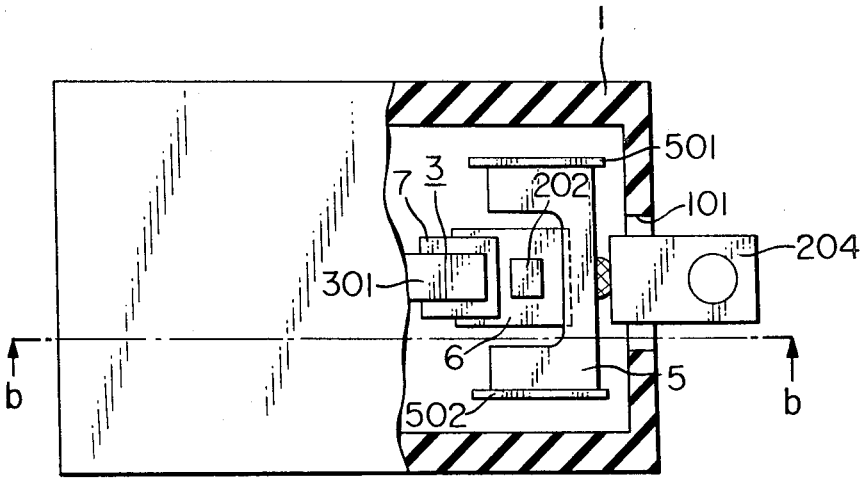
FIG. 12*a* is a partial sectional plan view showing another embodiment of the circuit breaker according to the present invention.
Figure 12B:
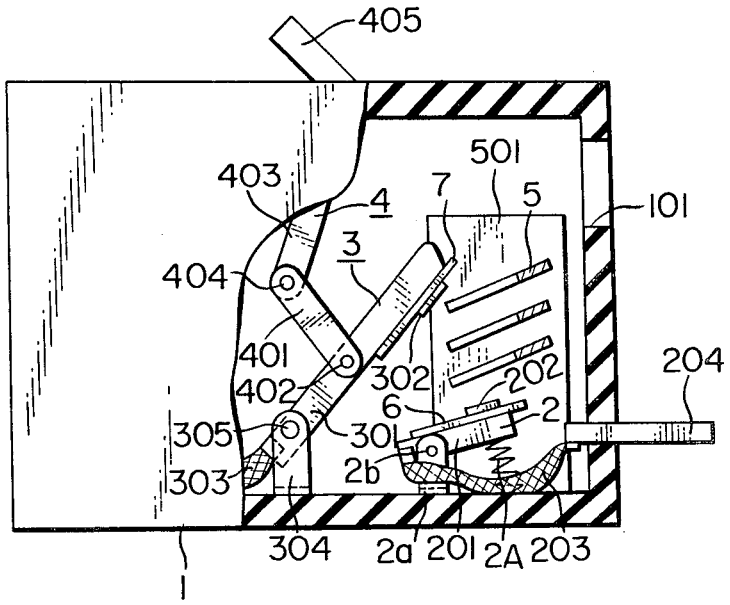
FIG. 12*b* is a partial sectional side view taken along line b—b in FIG. 12*a*, and shows the state in which the contacts of the circuit breaker are disengaged.

FIG. 12(*a*) is a sectional plan view showing another embodiment of the circuit breaker according to this invention, while FIG. 12(*b*) is a sectional side view taken along line b-b in FIG. 12(*a*). In FIGS. 12(*a*) and 12(*b*), an enclosure 1 is made of an insulator material and forms the outer frame of a switching device, and it is provided with an exhaust port 101.

A first contactor 2 is constituted by a first rigid conductor 201 which is turnably supported by a pivot pin 2*b* on a holder 2*a* that is fixed to the enclosure 1, and a first contact 202 which is mounted on one end part of the first rigid conductor 201. The first rigid conductor 201 is connected to a connection terminal 204 through a flexible conductor 203. A second contactor 3 moves relative to the first contactor 2 in order to close or open the circuit breaker, and it is constituted by a second rigid conductor 301 which is operated relative to the first rigid conductor 201 so as to close or open the circuit breaker, and a second contact 302 which is mounted on one end part of the second rigid conductor 301 in a position oppose the first contact 202. The second rigid conductor 301 is connected to an external conductor (not shown) through a flexible conductor 303, and the other end part thereof is turnably held by a pivot pin 305 on a holder 304 that is fixed to the enclosure 1. A spring 2A is interposed between the first rigid conductor 201 and the enclosure 1, and urges the first contact 202 against the second contact 302. An operating mechanism 4 operates the second contactor 3 so as to close or open the circuit breaker, and it has one end part of a lower link 401 constituting a linkage turnably coupled to the second rigid conductor 301 by a pivot pin 402, and one end part of an upper link 403 is turnably coupled to the other end part of the lower link 401 by a pivot pin 404, and an operating handle 405 is turnably coupled to the other end part of the upper link 403 by a pivot pin (not shown). Arc extinguishing plates 5 extinguish an electric arc struck when the second contact 302 is separated from the first contact 202, and they are supported by a pair of side plates 501 and 502. Arc shields 6 and 7 made of the aforementioned high resistivity material, are respectively mounted on the first and second rigid conductors 201 and 301 in a manner to protect the first and second contacts 202 and 302 and to oppose to the electric arc.

Figure 13:
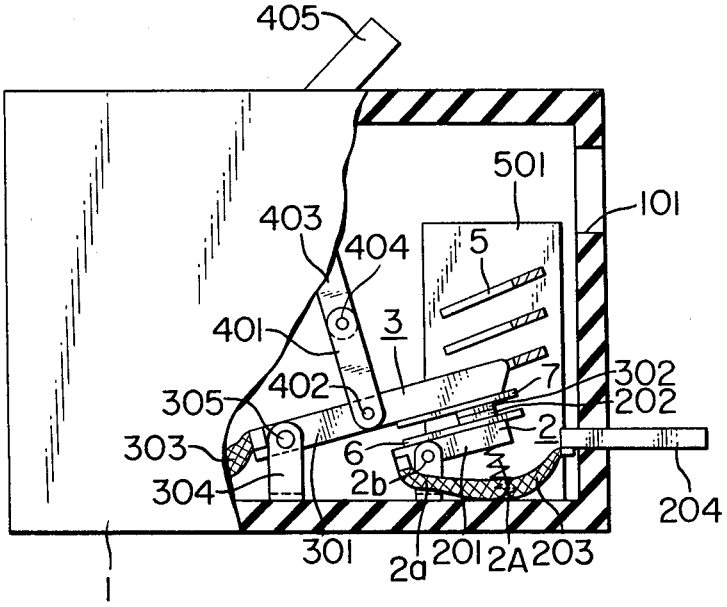
FIG. 13 is a sectional side view showing the state in which the contacts of the circuit breaker in FIG. 12*a* are engaged.
Figure 14:
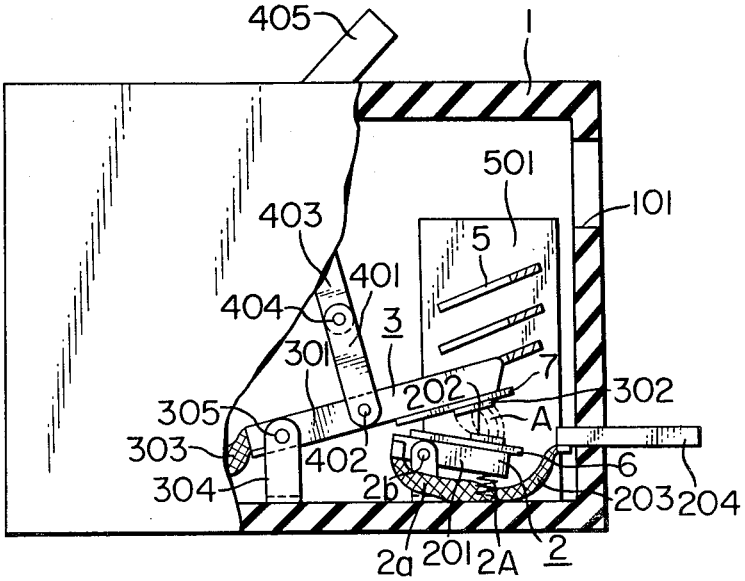
FIG. 14 is a partial sectional side view showing the state in which the contacts of the circuit breaker in FIG. 12*a* have begun to separate.

Next, the operation of the embodiment will be described. When the operating handle 405 is turned clockwise, the first and second contacts 202 and 302 are engaged as illustrated in FIG. 13. When, with the parts in this state, a high current such as short-circuit current flows, the first and second rigid conductors 201 and 301 are electromagnetically repelled on account of parallel currents which flow through these rigid conductors in senses opposite to each other, and the first rigid conductor 201 is separated as shown in FIG. 14, so that the electric arc A develops across the first and second contacts 202 and 302. Subsequently, the operating mechanism 4 works to completely separate the second rigid conductor 301. In the arc A in this case, as illustrated in FIG. 8, metal particles are reflected by the arc shields 6 and 7 to make the pressure in the arc space high, with the result that the arc is effectively cooled and extinguished.

The present embodiment is constructed as described above, and the first rigid conductor 201 is turnably held on the holder 2*a* by the pivot pin 2*b*. Therefore, when the high current such as short-circuit current flows, the first and second rigid conductors 201 and 202 are electromagnetically repelled by the currents flowing therethrough, without waiting from the operation of the operating mechanism 4, so that the first rigid conductor 201 is separated to generate the arc A. Upon the generation of the arc A, the pressure in the space Q between the arc shields 6 and 7 becomes very high, and hence the first and second rigid conductors 201 and 301 can be separated at very high speed by the effect of the arc shields 6 and 7 in addition to the electromagnetic repellent force, so that the arc voltage starts rising very quickly and rises very greatly. Accordingly, the peak value of the current caused to flow through the circuit can be made very small, the arc voltage can be made substantially higher than in the prior-art circuit breaker, and a very high current-limiting performance can be attained.

Figure 15A:
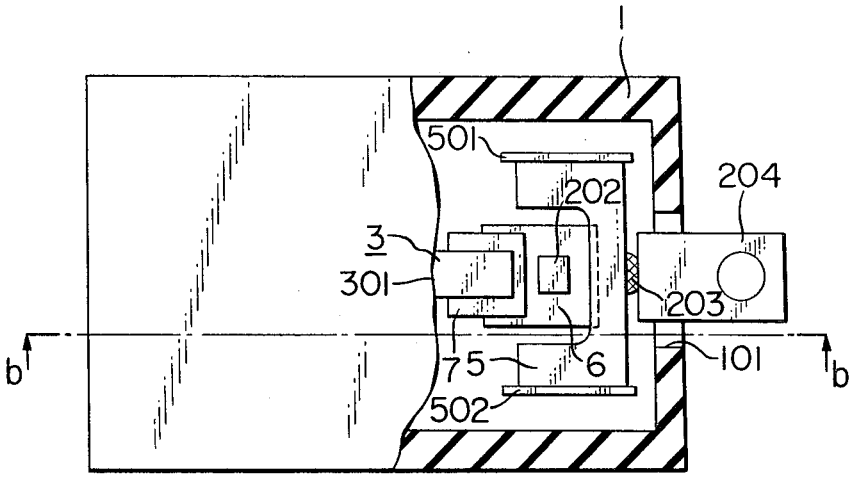
FIG. 15*a* is a partial sectional plan view showing still another embodiment of the circuit breaker according to the present invention.
Figure 15B:
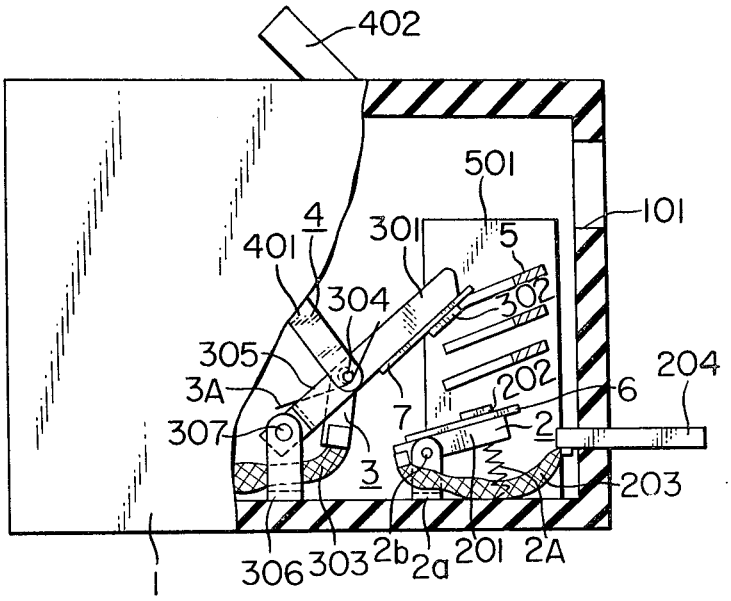
FIG. 15*b* is a partial sectional side view taken along line b—b in FIG. 15*a*, and shows the state in which the contacts of the circuit breaker are disengaged.

FIG. 15(*a*) is a sectional plan view showing another embodiment, while FIG. 15(*b*) is a side sectional view taken along line b-b in FIG. 15(*a*). In FIGS. 15(*a*) and 15(*b*), an enclosure 1 is made of an insulator material and forms the outer frame of a switching device, and it is provided with an exhaust port 101. A first contactor 2 is constituted by a first rigid conductor 201, and a first contact 202 which is mounted on one end part of the first rigid conductor 201, the other end part of which is turnably supported by a pivot pin 2*b* on a holder 2*a* fixed to the enclosure 1. The first rigid conductor 201 is connected to a connection terminal 204 through a flexible conductor 203. A second contactor 3 moves relative to the first contactor 2 in order to close or open the circuit breaker, and it is constituted by a second rigid conductor 301 which is operated relative to the first rigid conductor 201 so as to close or open the circuit breaker, and a second contact 302 which is mounted on one end part of the second rigid conductor 301 in a position to oppose the first contact 202. The second rigid conductor 301 is connected to an external conductor (not shown) through a flexible conductor 303, and the intermediate part thereof is turnably supported on one end part of a movable frame member 305 by a pivot pin 304. The other end part of the movable frame member 305 is turnably supported on a supporter 306 by a pivot pin 307. A spring 2A is interposed between the first rigid conductor 201 and the enclosure 1, and a torsion spring 3A is mounted on the pivot pin 304 and has its respective end parts held in engagement with the second rigid conductor 301 and the movable frame member 305. These springs urge the first and second contacts 202 and 302, respectively into engagement thereof. An operating mechanism 4 operates the second contactor 3 so as to close or open the circuit breaker, and it has one end part of a lower link 401 constituting a linkage turnably coupled to the pivot pin 304 and also an operating handle 402 turnably coupled to the linkage. Arc extinguishing plates 5 extinguish an electric arc struck when the second contact 302 is separated from the first contact 202, and they are supported by a pair of side plates 501 and 502. Arc shields 6 and 7 made of the aforementioned high resistivity material are respectively mounted on the first and second rigid conductors 201 and 301 in a manner to protect the first and second contacts 202 and 302 and to oppose to the electric arc A.

Figure 16:
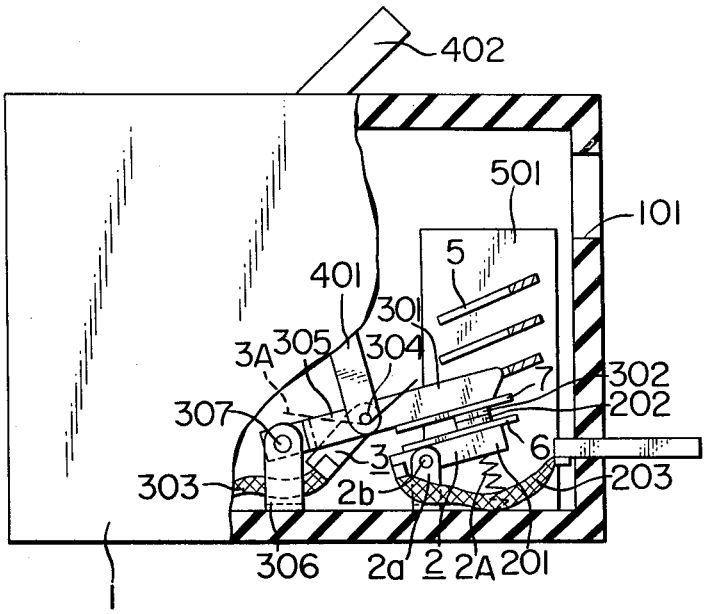
FIG. 16 is a partial sectional side view showing the state in which the contacts of the circuit breaker in FIG. 15*a* are engaged.
Figure 17:
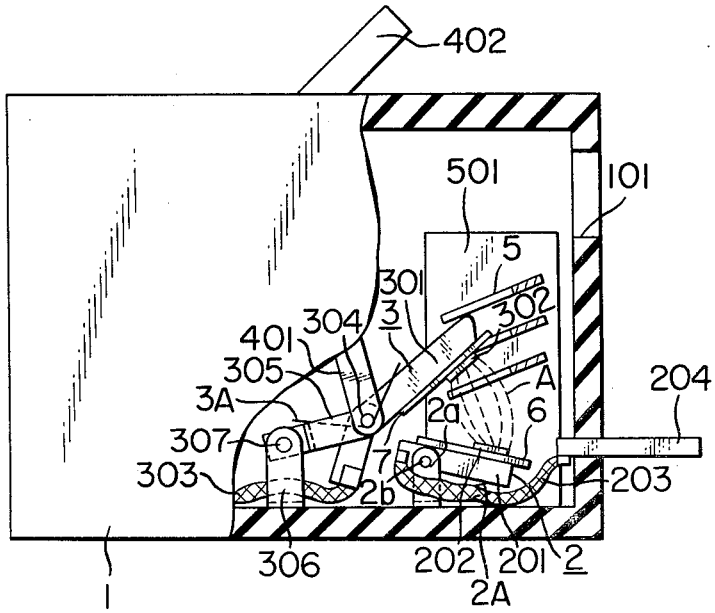
FIG. 17 is a partial sectional side view showing the state in which the contacts of the circuit breaker in FIG. 15*a* have begun to separate.

When the operating handle 402 is turned clockwise, the first and second contacts 202 and 302 are engaged as illustrated in FIG. 16. When a high current such as short-circuit current flows with the parts in this state, the first and second rigid conductors 201 and 301 are electromagnetically repelled on account of parallel currents in senses opposite to each other flowing through these rigid conductors, and the first and second rigid conductors 201 and 301 are both separated, so that the electric arc A develops across the first and second contacts 202 and 302 as illustrated in FIG. 17. Thereafter, the operating mechanism 4 works to completely separate the second rigid conductor 301. In the arc A in this case, as illustrated in FIG. 8, metal particles are reflected by the arc shields 6 and 7 to make the pressure in the arc space high, with the result that the arc is effectively cooled and extinguished.

The present embodiment is constructed as described above, and the other end part of the second rigid conductor 301 is turnably supported on the movable frame member 305 by the pivot pin 304, the other end part of the first rigid conductor 201 is turnably supported on the supporter 2*a* by the pivot pin 2*b*, and the currents flowing through the first and second rigid conductors 201 and 301 are parallel and opposite in sense to each other. Therefore, when the high current such as short-circuit current flows, the first and second rigid conductors 201 and 301 are electromagnetically repelled by the currents flowing therethrough, without waiting for the operation of the operating mechanism 4. The electromagnetic repellence separates both the first and second rigid conductors 201 and 301, to generate the arc A. Upon the generation of the arc A, the rigid conductors can be separated at very high speed by the pressure rise in the space Q between the arc shields 6 and 7, in addition to the electromagnetic repellent force. Accordingly, the arc voltage starts rising very quickly. Since both the first and second rigid conductors 201 and 301 separate, the arc length stretches, and this raises the arc voltage very greatly conjointly with the effect of the arc shields 6 and 7, so that the peak value of the current flowing through the circuit can be made very small.

In a circuit breaker for alternating current, the polarity of the current on a contact during arcing is not constant, and moreover, the polarity on the contact changes even during arcing. In this regard, the circuit breaker of the present embodiment can prevent the polarity effect on the current-limiting performance from becoming different in dependence on whether the polarity on the contact to be separated by the electromagnetic repellence is a cathode or an anode, and it can stabilize the current-limiting performance. That is, such beneficial result is achieved by the measure that both the first rigid conductor 201 and the second rigid conductor 301 on which the first contact 202 and the second contact 302 are respectively mounted are constructed as turnable electromagnetic repulsion type conductors.

Figure 18A:
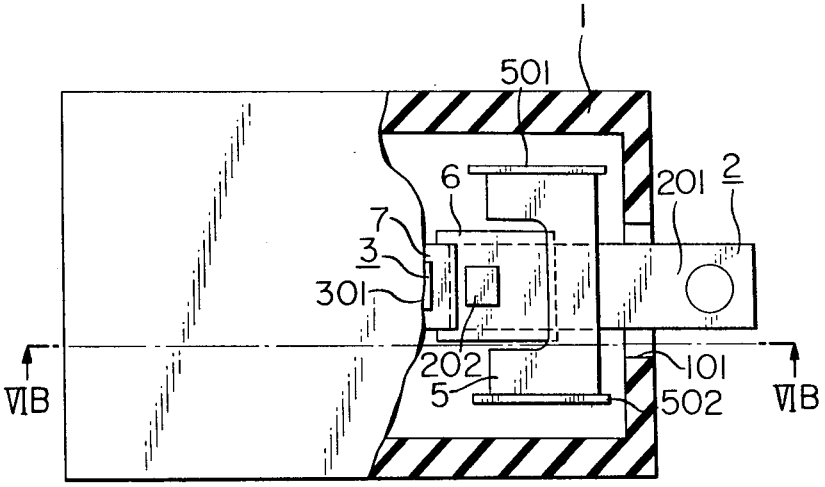
FIG. 18*a* is a partial sectional plan view showing a further embodiment of the circuit breaker according to the present invention.
Figure 18B:
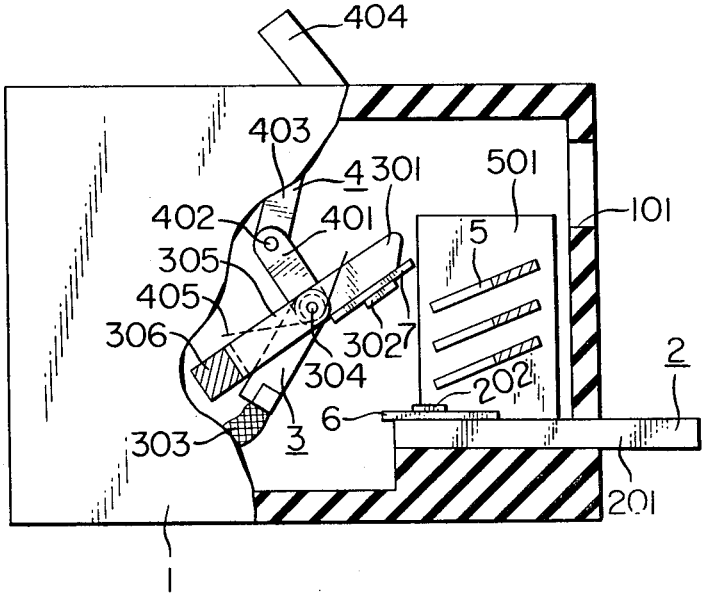
FIG. 18*b* is a partial sectional side view taken along line b—b in FIG. 18*a*, and shows the state in which the contacts of the circuit breaker are disengaged.

FIG. 18(*a*) is a sectional plan view showing still another embodiment, while FIG. 18(*b*) is a side sectional view taken along line b-b in FIG. 18(*a*). In FIGS. 18(*a*) and 18(*b*), an enclosure 1 is made of an insulator material and forms the outer frame of a switching device, and it is provided with an exhaust port 101. A stationary contactor 2 is constituted by a stationary rigid conductor 201 which is fixed to the enclosure 1, and a stationary-side contact 202 which is mounted on one end part of the stationary rigid conductor 201. A movable contactor 3 moves relative to the stationary contactor 2 in order to close or open the circuit breaker, and it is constituted by a movable rigid conductor 301 which is operated relative to the stationary contactor 2 so as to close or open the circuit breaker, and a movable-side contact 302 which is mounted on one end part of the movable rigid conductor 301 in a position to oppose the stationary-side contact 202. The movable rigid conductor 301 is connected to an external conductor (not shown) through a flexible conductor 303, and the intermediate part thereof is turnably supported on one end part of a movable frame member 305 by a pivot pin 304. A cross bar 306 is provided on the other end part of the movable frame member 305 in a direction perpendicular to the sheet of the drawing, and it turnably supports the movable frame member 305 in each phase. An operating mechanism 4 operates the movable contactor 3 so as to close or open the circuit breaker, and it is constituted by a lower link 401 one end part of which is turnably mounted on the intermediate part of the movable rigid conductor 301 by the pivot pin 304, an upper link 403 one end part of which is turnably mounted on the other end part of the lower link 401 by a pivot pin 402, an operating handle 404 which is turnably mounted on the other end part of the upper link 403 by a pivot pin (not shown), and a torsion spring 405 which is engaged with the pivot pin 304 and has its respective end parts held in engagement with the movable rigid conductor 301 and the movable frame member 305. Arc extinguishing plates 5 extinguish an electric arc struck when the movable-side contact 302 is separated from the stationary-side contact 202, and they are held by a pair of side plates 501 and 502. Arc shields 6 and 7 made of the aformentioned high resistivity material are respectively mounted on the stationary rigid conductor 201 and the movable rigid conductor 301 in a manner to protect the stationary-side contact 202 and the movable-side contact 302 and to oppose to the electric arc A.

Figure 19:
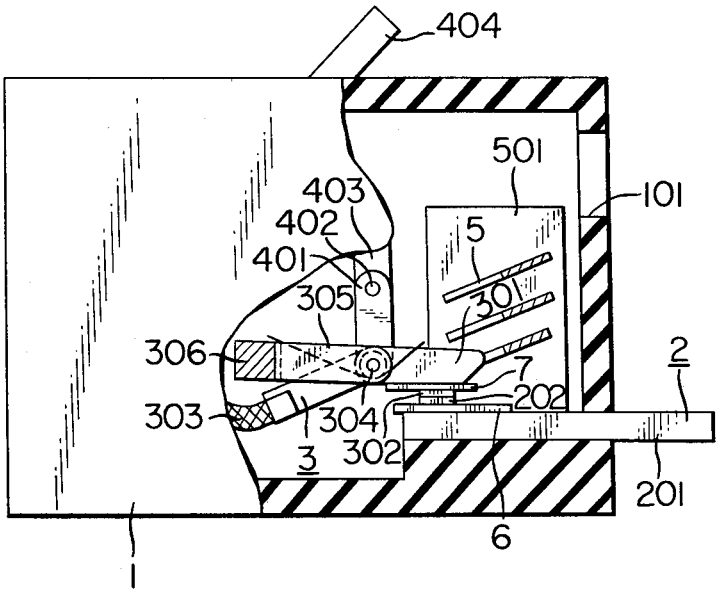
FIG. 19 is a partial sectional side view showing the state in which the contacts of the circuit breaker in FIG. 18*a* are engaged.
Figure 20:
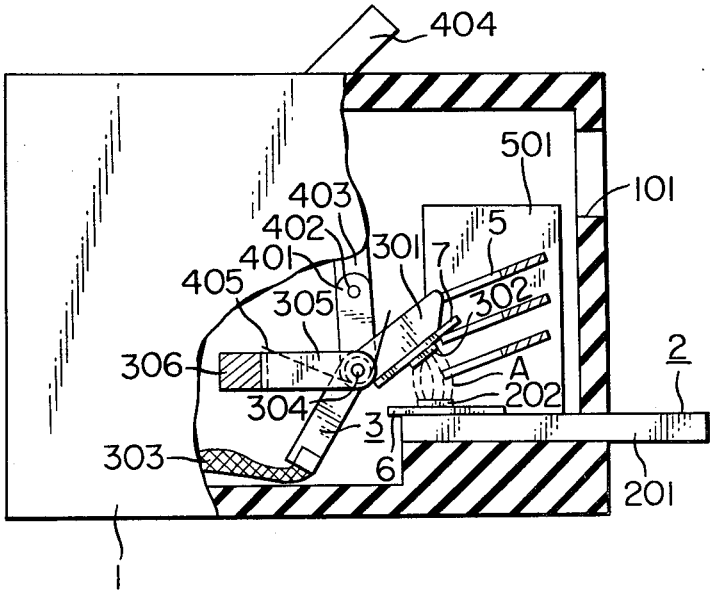
FIG. 20 is a partial sectional side view showing the state in which the contacts of the circuit breaker in FIG. 18*a* have begun to separate.

When the operating handle 404 is turned clockwise, the movable-side contact 302 and the stationary-side contact 202 are engaged as illustrated in FIG. 19. With the parts in this state, current flows from a power supply side onto a load side along the stationary rigid conductor 201→stationary-side contact 202→movable-side contact 302→movable rigid conductor 301. In this state, the directions of currents flowing through the movable rigid conductor 301 and the stationary rigid conductor 201 are the same. Therefore, even in case a comparatively great current flows repulsion between the movable rigid conductor 301 and the stationary rigid conductor 201 based on the currents flowing therethrough does not take place. This is, even when a comparatively great instantaneous current flows, the repulsion between the stationary-side contact 202 and the movable-side contact 302 does not occur, so that the stationary-side contact 202 and the movable-side contact 302 wear little and can be prevented from fusing and depositing. Now, when a high current such as short-circuit current flows through the circuit, the operating mechanism 4 works to separate the movable-side contact 302 from the stationary-side contact 202. At this time, the electric arc A develops across the stationary-side contact 202 and the movable-side contact 302. This state is illustrated in FIG. 20. In the arc A, as illustrated in FIG. 8, metal particles are reflected by the arc shields 6 and 7 to make the pressure in the arc space high, with the result that the arc is effectively cooled and extinguished.

This embodiment is constructed as described above, and the movable rigid conductor 301 is turnably held on the movable frame member 305 by the pivot pin 304 and besides the arc shields 6 and 7 are provided. Accordingly, although the operating mechanism 4 produces a low separating speed of the movable rigid conductor 301 on account of its inertia, the pressure in the space Q between the arc shields 6 and 7 becomes very high and the movable rigid conductor 301 is therefore pivoted about 304 against spring 405 and separated at very high speed without waiting for the drive of the operating mechanism 4. In consequence, the rise of the arc voltage immediately after the separation is rapid, and this suppresses the peak value of the current flowing through the circuit, conjointly with the effect of narrowing the arc A by the arc shields 6 and 7, so that a high current-limiting effect can be attained.

Figure 21A:
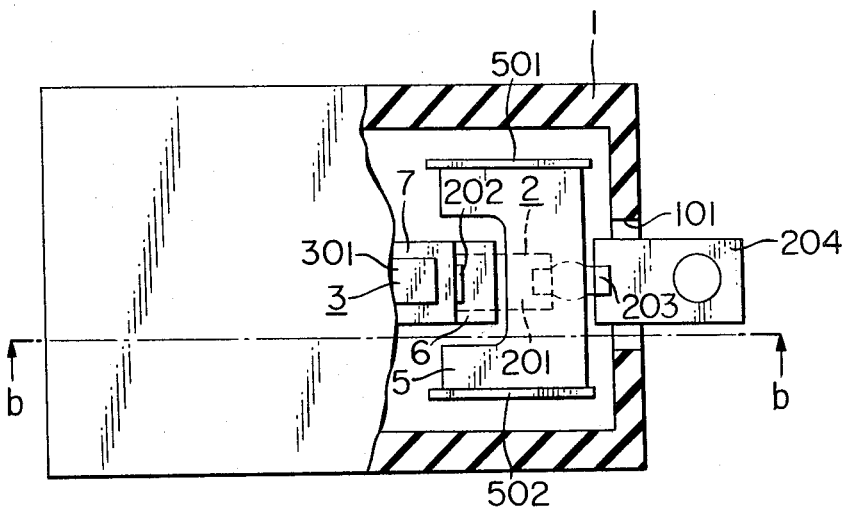
FIG. 21*a* is a partial sectional plan view showing a still further embodiment of the circuit breaker according to the present invention.
Figure 21B:
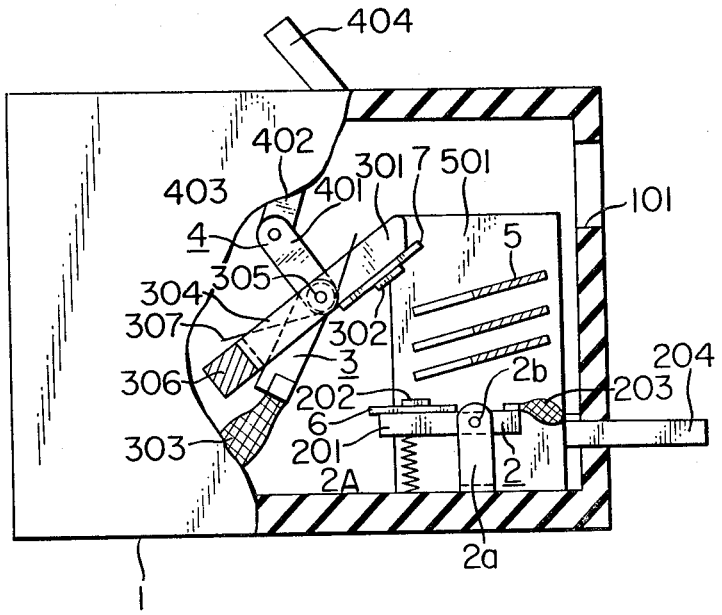
FIG. 21*b* is a partial sectional side view taken along line b—b in FIG. 21*a*, and shows the state in which the contacts of the circuit breaker are disengaged.
Figure 22:
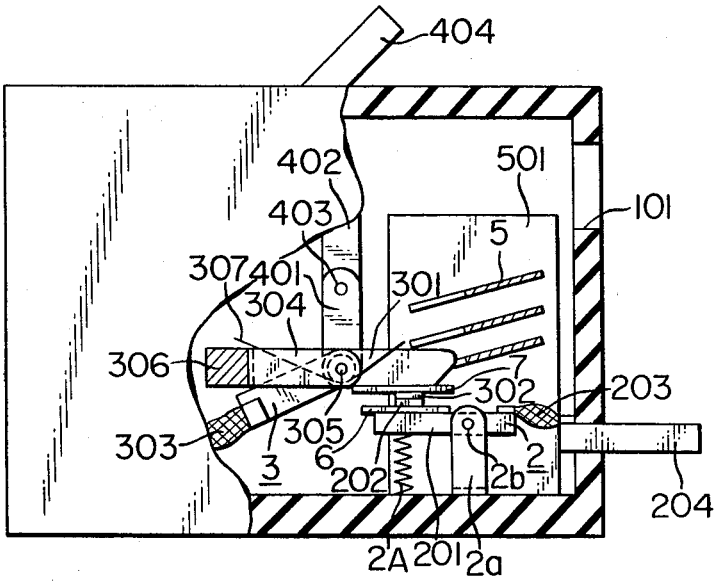
FIG. 22 is a partial sectional side view showing the state in which the contacts of the circuit breaker in FIG. 21*a* are engaged.
Figure 23:
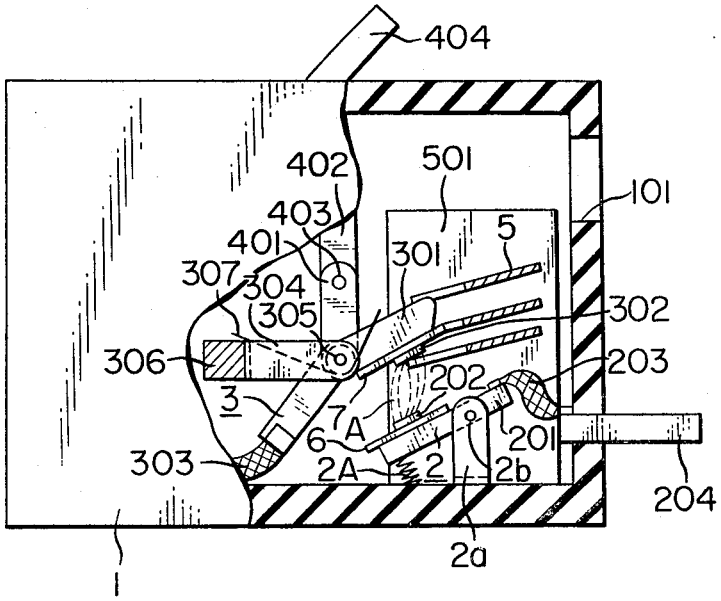
FIG. 23 is a partial sectional side view showing the state in which the contacts of the circuit breaker in FIG. 21*a* have begun to separate.

FIG. 21(*a*) is a sectional plan view showing yet another embodiment, while FIG. 21(*b*) is a side sectional view taken along line b-b in FIG. 21(*a*). In FIGS. 21(*a*) and 21(*b*), an enclosure 1 is made of an insulator material and forms the outer frame of a switching device, and it is provided with an exhaust port 101. A first contactor 2 is constituted by a first rigid conductor 201 which is turnably supported by a pivot pin **2*b* on a holder 2*a* fixed to the enclosure 1, and a first contact 202 which is mounted on one end part of the first rigid conductor 201. The first rigid conductor 201 is connected to a connection terminal 204 through a flexible conductor 203. A second contactor 3 moves relative to the first contactor 2 in order to close or open the circuit breaker, and it is constituted by a second rigid conductor 301 which is operated relative to the first rigid conductor 201 so as to close or open the circuit breaker, and a second contact 302 which is mounted on one end part of the second rigid conductor 301 in a position of oppose the first contact 202. The second rigid conductor 301 is connected to an external conductor (not shown) through a flexible conductor 303, and the intermediate part thereof is turnably held on one end part of a movable frame member 304 by a pivot pin 305. A cross bar 306 is mounted on the other end part of the movable frame member 304 in a direction perpendicular to the sheet of the drawing, and it moves the movable frame member simultaneously in each phase. A torsion spring 307 is engaged with the pivot pin 305, and has its respective end parts held in engagement with the second rigid conductor 301 and the movable frame member 304. A spring 2A is interposed between the first rigid conductor 201 and the enclosure 1, and urges the first contact 202 against the second contact 302. An operating mechanism 4 operates the second contactor 3 in order to close or open the circuit breaker, and it has one end part of a lower link 401 constituting a linkage turnably coupled to the second rigid conductor 301 by the pivot pint 305, one end part of an upper link 402 turnably coupled to the other end part of the lower link 401 by a pivot pin 403 and an operating handle 414 turnably coupled to the other end part of the upper link 402 by a pivot pin (not shown). Arc extinguishing plates 5 extinguish an electric arc struck when the second contact 302 is separated from the first contact 202, and they are supported by a pair of side plates 501 and 502. Arc shields 6 and 7 made of the aforementioned high resistivity material are respectively mounted on the first and second rigid conductors 201 and 301** in a manner to protect the first and second contacts 202 and 302 and to oppose to the electric arc. When the operating handle 404 is turned clockwise, the first and second contacts 202 and 302 are engaged as illustrated in FIG. 22. When a high current such as short-circuit current flows with the parts in this state, the first and second rigid conductors 201 and 301 are not repelled electromagnetically because of parallel currents in an identical sense which flow through these rigid conductors, and the first rigid conductor 201 is separated as illustrated in FIG. 23, so that the electric arc A develops across the first and second contacts 202 and 302. Subsequently, the operating mechanism 4 works to completely separate the second rigid conductor 301. In the arc A in this case, as illustrated in FIG. 8, metal particles are reflected by the arc shields 6 and 7 to make the pressure in the arc space high, with the result that the arc is effectively cooled and extinguished.

This embodiment is constructed as described above, and the first rigid conductor 201 is pivotably held on the holder 2*a* and rigid conductor 301 is held on movable frame member 304 by the pivot pin 305 and besides the arc shields 6 and 7 are provided. Accordingly, although the operating mechanism 4 produces a low separating speed of the movable rigid conductor 301 and first rigid conductor 201 on account of its inertia, the pressure in the space Q between the arc shields 6 and 7 becomes very high and the movable rigid conductor 301 and first conductor are therefore separated at very high speed without waiting for the drive of the operating mechanism 4. In consequence, the rise of the arc voltage immediately after the separation is rapid, and this suppresses the peak value of the current to flow through the circuit, conjointly with the effect of narrowing the arc A by the arc shields 6 and 7, so that a high current-limiting effect can be attained. Further, even when a comparatively great instantaneous current has flowed, the repulsion between the first and second contacts 202 and 302 does not take place unnecessarily.

In a circuit breaker for alternating current, the polarity of the current on a contact during arcing is not constant, and moveover, the polarity on the identical contact changes even during arcing. In this regard, the circuit breaker of the present embodiment can prevent the polarity effect on the current-limiting performance from becoming different depending upon whether the polarity on the contact to be separated by the electromagnetic repellence is a cathode or an anode, and it can stabilize the current-limiting performance. That is, such beneficial result is achieved by the measure that both the first rigid conductor 201 and the second rigid conductor 301 on which the first contact 202 and the second contact 302 are respectively mounted are turnable electromagnetic repulsion type conductors.

What is claimed is:

1. A circuit breaker comprising:

a pair of contactors, one of said contactors being a movable contactor and having the entire contactor relatively movable away from and toward the other contactor to open and close an electric circuit, each of said contactors having a conductor and a contact secured thereto, said contacts abutting each other when said conductors are close to each other;

arc shields of a material having a resistivity greater than the material of said conductors and said contacts, one positioned on each of said contactors surrounding the periphery of said contacts for narrowing the arc generated between said contacts when said contacts separate, and increasing the pressure in the arc;

means connected to said movable contactor and responsive to the flow of current through said contacts for moving said movable contactor away from the other contactor when a flow of short circuiting current flows through said contacts and said means, said means having an inertia which causes said movable contactor to have a comparatively low separating speed from said other contactor; and at least one of said contactors having at least a part of the conductor which extends from the contact toward the other end thereof pivotally mounted for pivoting movement away from the contact position of said contacts and spring means urging said pivotally mounted part of the conductor toward the contact position with a force less than that which can be overcome by the pressure in the narrowed arc, said pivotally mounted part being pivotable away from the opposed contact due to the arc pressure faster than said current flow responsive means moves said movable contactor away from said other contactor.

2. A circuit breaker as claimed in claim 1 in which the other contactor has the conductor thereof pivotally mounted about a fixed pivot for pivoting movement away from the contact position of said contacts and spring means urging said pivotally mounted conductor toward the contact position with a force less than that which can be overcome by the pressure in the narrowed arc.

3. A circuit breaker as claimed in claim 1 in which said movable contactor has said part of the conductor on which the contact therefor is mounted pivotally mounted for pivoting movement relative to the remainder of said conductor of the movable contactor away from the contact position of said contacts, and spring means urging said pivotally mounted part toward the contact position with a force less than that which can be overcome by the pressure in the narrowed arc.

4. A circuit breaker as claimed in claim 1 in which the other contactor has the conductor thereof pivotally mounted about a fixed pivot for pivoting movement away from the contact position of said contacts, and spring means urging said pivotally mounted conductor toward the contact position with a force less than that which can be overcome by the pressure in the narrowed arc, and said movable contactor has a part of the conductor on which the contact therefor is mounted pivotally mounted for pivoting movement relative to the remainder of said movable contactor away from the contact position of said contacts, and further spring means urging said pivotally mounted part toward the contact position with a force less than that which can be overcome by the pressure in the narrowed arc.

5. A circuit breaker as claimed in claim 1 in which the conductors of said contactors, when said contactors are in the contact position, extend generally side-by-side, and are connected for causing the current flows through said conductors to repel said conductors.

* * * * *